US010464352B2

(12) United States Patent
Clevers

(10) Patent No.: US 10,464,352 B2
(45) Date of Patent: Nov. 5, 2019

(54) DUPLEX PRINTING METHOD

(71) Applicant: Océ Holding B.V., Venlo (NL)

(72) Inventor: Ernest J. J. Clevers, Broekhuizervorst (NL)

(73) Assignee: OCÉ HOLDING B.V., Venlo (NL)

( * ) Notice: Subject to any disclaimer, the term of this patent is extended or adjusted under 35 U.S.C. 154(b) by 0 days.

(21) Appl. No.: 16/141,493

(22) Filed: Sep. 25, 2018

(65) Prior Publication Data

US 2019/0100041 A1 Apr. 4, 2019

(30) Foreign Application Priority Data

Oct. 3, 2017 (EP) ..... 17194558

(51) Int. Cl.

| | |
|---|---|
| ***B41J 13/00*** | (2006.01) |
| ***B41J 11/00*** | (2006.01) |
| ***B41J 3/60*** | (2006.01) |
| ***G03G 15/23*** | (2006.01) |
| ***G03G 15/00*** | (2006.01) |

(52) U.S. Cl.

CPC ..... *B41J 13/0009* (2013.01); *B41J 3/60* (2013.01); *B41J 11/007* (2013.01); *B41J 11/0095* (2013.01); *B41J 13/0018* (2013.01); *G03G 15/23* (2013.01); *G03G 15/55* (2013.01); *G03G 15/5029* (2013.01)

(58) Field of Classification Search

CPC ..... B41J 13/0009; B41J 3/60; B41J 11/007; B41J 11/0095

See application file for complete search history.

(56) References Cited

U.S. PATENT DOCUMENTS

| | | | | |
|---|---|---|---|---|
| 2003/0025779 | A1* | 2/2003 | Miyazaki | B41J 2/355 347/171 |
| 2005/0030333 | A1* | 2/2005 | Takahashi | B41J 3/60 347/19 |
| 2016/0103634 | A1 | 4/2016 | Van Acquoij | |

FOREIGN PATENT DOCUMENTS

| | | | |
|---|---|---|---|
| EP | 3 007 133 | A2 | 4/2016 |
| EP | 3 007 421 | A1 | 4/2016 |
| WO | WO 2016/177676 | A1 | 11/2016 |

OTHER PUBLICATIONS

European Search Report for EP 17 19 4558, dated Mar. 16, 2018.

* cited by examiner

*Primary Examiner* — Jason S Uhlenhake

(74) *Attorney, Agent, or Firm* — Birch, Stewart, Kolasch & Birch, LLP

(57) ABSTRACT

A method of duplex printing on a cut sheet printer having a sheet supply system for feeding sheets to a print station in a first orientation for printing a first image on the first side of the sheet and then in a second orientation for printing a second image on a second side of the sheet includes, for each sheet: (a) estimating a likelihood P1 that, in a print process for printing the first image, the sheet will become damaged to such an extent that the damage will compromise a later print process for printing the second image; (b) comparing the likelihood P1 to a threshold T; and (c) if the likelihood P1 exceeds the threshold T, reversing the print order so that the second image is printed before the first image. The method ensures that the riskier image is printed on the duplex pass. The chances of the sheet with the simplex image then successfully passing through the duplex pass are then increased.

11 Claims, 4 Drawing Sheets

Fig. 4

Log

| # | Cause | Origin | Media | Page No. | Time |
|---|---|---|---|---|---|
| | | | | | |
| | | | | | |
| | | | | | |
| | | | | | |

Log

Fig. 5

Pages

| | T | N | D | D/N | print order |
|---|---|---|---|---|---|
| 1 | 0.001 | 8550 | 7 | 0.0008 | normal |
| 2 | | | | | |
| 3 | 0.001 | 4000 | 5 | 0.0013 | normal |
| 4 | | 4550 | 2 | 0.0004 | reversed |
| 5 | 0.004 | 8500 | 20 | 0.0011 | normal |
| 6 | | 50 | 2 | 0.004 | reversed |
| 7 | 0.001 | 8550 | 7 | 0.0008 | normal |
| 8 | | | | | |

Pages

DUPLEX PRINTING METHOD

The invention relates to a method of duplex printing on a cut sheet printer having a print station and a sheet supply system capable of feeding media sheets to the print station in a first orientation for printing a first image on a first side of the sheet and then in a second orientation for printing a second image on a second side of the sheet.

A printer to which the invention is applicable has been disclosed in WO 2016/177676 A1. In this printer, a sentry is arranged upstream of the print station for checking the quality of the sheets. When the sentry finds that a sheet is damaged, meaning for example that the sheet comprises an out-of-plane deformation, e.g. when the sheet is curled, warped and/or wrinkled, to such an extent that the print quality would be compromised or the sheet would collide with a print head in the print station, the defective sheet is discarded and the allocation of images to be printed to the subsequent sheets is re-scheduled such that the print order is preserved. In this way, it can in many cases be avoided that the print process must be aborted.

In duplex printing, the treatments applied to the media sheets in the process of printing a first image on the first side of the sheet may sometimes lead to a deformation of the media sheet. For example, in an ink jet printer, the media sheets are wetted when liquid ink is applied and are then subjected to heat or radiation in order to cure the ink and to dry the sheet. These treatments may cause the sheet to develop an out-of-plane deformation by e.g. warping or deforming, so that the height of the sheet becomes uneven. Then, when the same sheet is fed to the print station a second time in order to print a second image on the back side, the height variations of the sheet may be too large in view of the narrow gap which the print head forms with the media sheets, so that the print quality is compromised or the sheet even collides with the print head.

In a conventional duplex print process, when a sheet arriving from the duplex path turns out to be damaged, it is not only the damaged sheet that has to be discarded, but all other sheets that follow in the duplex path and bear already an image on the front side have to be discarded as well, and printing with a correct page order can only be resumed after the entire duplex path has been emptied. This may imply not only a loss in productivity by also a considerable waste of material, especially when the duplex path is capable of accommodating a large number of sheets.

It is an object of the invention to provide a duplex printing method which permits a high productivity and/or a reduced waste of material even in cases where media sheets tend to become deformed and/or damaged.

In order to achieve this object, the method according to the invention is characterized by comprising, for each sheet, the steps of:

(a) estimating a likelihood P1 that, in a print process for printing the first image, the sheet will become damaged to such an extent that the damage will compromise a later print process for printing the second image;

(b) comparing the likelihood P1 to a threshold T; and (c) if the likelihood P1 exceeds the threshold T, reversing the print order so that the second image is printed before the first image.

When several copies of a multi-sheet document or set have to be printed, the likelihood that a sheet gets damaged in the way described above is usually not the same for all sheets of the document. Instead, even when all media sheets are of the same media type, the likelihood of damage may depend upon the image content to be printed thereon, because the image content determines the amount of liquid ink to be applied to the sheet as well as the distribution of the ink.

In the method according to the invention, the likelihood of damage is estimated in advance. If there is a high risk of damage for the first image, reversing the print order has the advantage that the first image is printed only at the end of the duplex cycle so that the printed sheet will not be returned to the print station anymore and, consequently, a possible damage can do no harm. The first part of the duplex cycle is used for printing the second image for which the risk of damage can be expected to be low.

More specific optional features of the invention are indicated in the dependent claims.

The likelihood P1 that a sheet becomes damaged in the process of printing the first image on the front side will typically depend upon several factors, including for example the amount of ink to be applied, the distribution of ink, the media type, the temperature to which the sheet is exposed during or after printing, the humidity content of the sheet, ambient air humidity, and the like. In one embodiment, a database stores a likelihood value for all realistic combinations of the above factors and the step (a) of estimating the likelihood P1 comprises identifying the parameters that apply to the particular sheet and then look-up the likelihood P1 in the database. The database may be established and updated on the basis of empirical data.

In another embodiment, the method may employ a self-learning algorithm for counting, separately for each of the sheets that are distinguished from one another by their intended image contents, the total number N of printed sheets as well as the number D of sheets which have become damaged. The likelihood of damage will then be approximated by the quotient D/N of these numbers.

Of course, it is also possible to combine these embodiments by using the self-learning algorithm for updating and refining the database.

In step (b) the threshold T may represent an average likelihood that the sheets of the given media type are found to be damaged for any reason, not specifically related to the process of printing the first image. In another embodiment the threshold T is specific to the sheet in consideration and represents a likelihood P2 that this sheet gets damaged in the process of printing the second image, the likelihood P2 being estimated in the same way as the likelihood P1, but based on data related to the second image and the print process for the second image, respectively.

When the print order has been reversed, it will in many cases be desired that the sheet on which an image has been formed on both sides is flipped once again in order to assure that the first side of the sheet will face downwards again, just as for all the other sheets for which the print order has not been reversed. In this way, it is assured that the page order of a multi-page document is preserved. Thereto, the printer may comprise a first sheet flipping or reversing mechanism as part of the duplex loop and a second sheet reversing mechanism at an output transport path downstream of the print station and leading to a sheet output position, such as a tray or finishing device. Alternatively, a single sheet flipping or reversing mechanism may be conveniently positioned such that a sheet selectively passes or bypasses said sheet reversing mechanism on its duplex pass depending on the image order of the images printed on the sheet.

In a printer that is adapted for carrying out the invention, it is convenient to have an extra or second sheet reversing mechanism downstream of the duplex loop, so that the last flipping of the sheet can be achieved without having to pass the sheet through the duplex loop once again, which would cause a delay in the print process. As explained above, the duplex loop may then comprise a first sheet reversing mechanism for flipping one-sided printed sheets with their blank side towards the print station.

Embodiment examples will now be described in conjunction with the drawings, wherein:

FIGS. 4 and 5 show screen images to be displayed on a user interface of the printer in conjunction with the method according to the invention.

Figure 1:
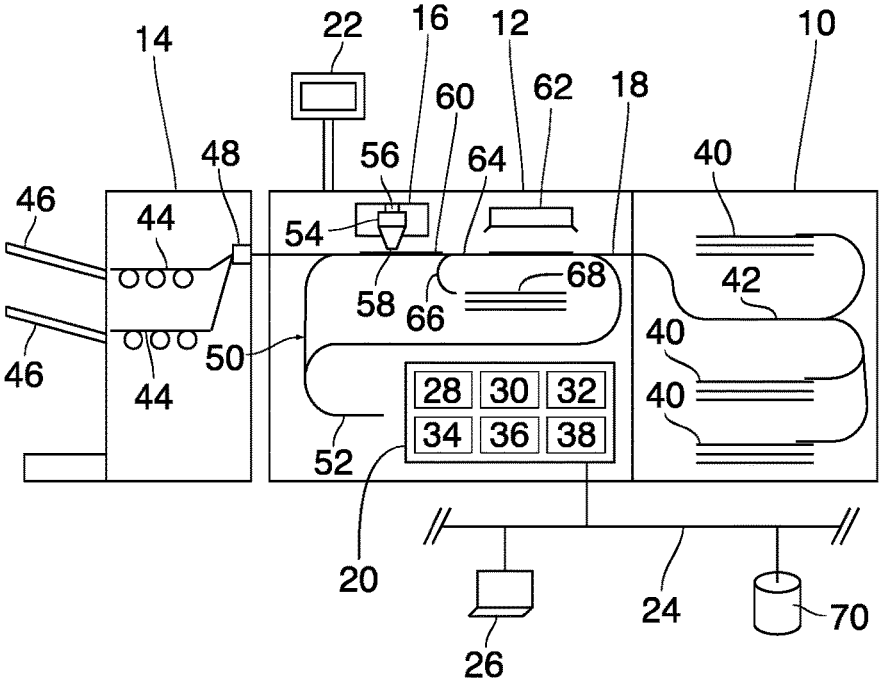
FIG. 1 is a schematic view of a printer to which the invention is applicable.

As is shown in FIG. 1, a printer that is described here as a representative example comprises an input section 10, a main body 12, and an output section 14. The main body 12 comprises a print station 16, a sheet supply system including a sheet transport path 18, an electronic controller 20 and a user interface 22.

The controller 20 may be formed by a computer, a server or a workstation and is connected to all the functional components of the printer for controlling the same and is further connected to the user interface 22 and to a network 24 via which the controller may communicate with a remote workstation 26 of a user or operator. In an alternative embodiment, the controller 20 may also be installed outside of the main body 12 for controlling the various system components via the network 24.

The hardware and/or the software of the controller 20 includes among others a print job receiving section 28, a scheduler 30, a feed control section 32, a print control section 34, an output control section 36, and a sheet manager 38. The print job receiving section 28 is arranged to receive, e.g. via the network 24, print jobs each of which includes image data for one or more pages to be printed as well as various job settings. Optionally, the image data may also be received from a local scanner whereas the job settings are input at the user interface 22. The job settings include among others instructions that specify for each image to be printed the properties or type of a recording medium on which the image shall be printed.

The input section 10 includes a plurality of holders 40 each of which accommodates a supply, e.g. a stack, of media sheets of a certain media type. The media types in the different holders 40 may differ in sheet thickness, sheet material, surface properties of the sheets and the like. The input section 10 further includes a feed mechanism 42 arranged to separate individual sheets from a selected one of the holders 40 and to supply them one by one into the sheet transport path 18 under the control of the feed control section 32.

When the job receiving section 28 has received a print job, the scheduler 30 determines a sequence in which the images of this print job shall be printed. The scheduler 30 further has access to a database that stores the media types and properties of the sheets accommodated in the various holders 40. Based on the job settings that concern the media properties, the scheduler 30 selects the holders 40 from which the sheets with the desired properties are to be taken and determines a sequence in which the sheets of the different media types are to be fed into the sheet transport path 18 such that the sequence of sheets matches the sequence of images to be printed.

When the print process has been started, the feed control section 32 controls the feed mechanism 42 to supply the sheets in the sequence as scheduled into the sheet transport path 18, and the print control section 34 controls the print station 16 so as to print a corresponding image on the top side of each sheet.

In the example shown, the output section 14 has a plurality of holders 44 on which the sheets may be stacked after they have left the print station 16. When a stack, which may for example comprise a set of sheets forming a complete copy of a multi-page document, has been completed, the holder 44 will forward the stack onto an associated output tray 46. In an alternative embodiment the completed stacks may also be forwarded to a finisher (not shown) for performing finishing operation such as stapling, punching and the like.

The output section 14 further includes a switch 48 which is controlled by the output control section 36 for directing each sheet to a designated one of the holders 44.

The main body 12 of the printing section includes a duplex path 50 which branches off from the sheet transport path 18 downstream of the print station 16, reverses the orientation of the sheets in a sheet reversing mechanism 52 and then returns the sheets upside down to the entry side of the sheet transport path 18.

It shall further be assumed in this example that the print station 16 includes as print engine an ink jet print head 54 that is disposed above the sheet transport path 18 and is adjustable in height by means of a height adjustment mechanism 56. Dependent upon the thickness and other properties of the sheets, the height of the print head 54 is adjusted such that a nozzle face 58 at the bottom side of the print head forms only a very narrow gap with a top surface of a sheet 60 that is being conveyed past the print head. In this way, it will be assured that, for each individual sheet, the ink jet print process will be performed with an optimal nozzle-to-sheet distance.

As the gap between the nozzle face 58 and the sheet 60 may be very small, any wrinkles or a surface waviness or other surface irregularities of the sheet 60 may result in a poor image quality or even in a collision of the sheet with the print head. For this reason, a sentry 62 for monitoring the quality of the sheets is disposed at the sheet transport path 18 upstream of the print station 16. The sentry 62 may for example be a 3D laser scanner that scans the entire surface of the sheet in order to capture a surface relief. An example is described in US 2016103634 A1. The relief data are transmitted to the sheet manager 38 in the controller 20, where they are processed further to decide whether the quality of the sheet is acceptable or not. In this specification, a sheet will be designated as "damaged" if the quality detected by the sensor 62 is not acceptable. The sentry 62 may also detect other quality criteria relating to, for example, alignment errors or skew errors of the sheets.

When a sheet is found to be damaged, the sheet manager 38 controls a switch 64 in the sheet transport path 18 in order to excise this sheet from the scheduled sequence and to divert it into a discharge path 66 via which the sheet is discharged into a discharge bin 68. In this way, the defective sheet will be skipped in the print process. However, the image that was designated for being printed onto the discarded sheet must nevertheless be printed. In duplex printing this may have the consequence that all the sheets that had been present already duplex path 50 have to be discarded as well, even if they are not damaged, because they wear the wrong image on their first side.

It should be observed in this context that FIG. 1 is only a schematic sketch and that, in practice, the number of sheets that can be accommodated in the duplex path 50 can be considerably large. For example, the duplex path 50 may be arranged to accommodate as many as 40 sheets.

The likelihood P1 of damage for a given sheet depends upon a number of factors such as the media type (thickness, dimensions and material of the sheet), humidity and temperature of the sheet, air humidity and temperature in the environment and during a curing or drying treatment of the sheet, chemical composition of the ink being used, the amount of ink applied on the first side of the image, the distribution of ink, and the like. The latter factors, in particular the amount and distribution of ink depend upon the image content of the image to be printed on the front side of the sheet. Consequently, the likelihood P1 can vary significantly from sheet to sheet and must therefore be determined independently for each sheet in the set.

In the example shown in FIG. 1, the controller 20 can access a database 70 via the network 24, and the database 70 stores likelihood values P1 for all combinations of the above-mentioned factors that may occur in practice. As regards the amount of ink to be applied, the likelihood may be a linear or non-linear function of that amount. As regards the distribution of ink, the images to be printed will be classified in one of a number of pre-defined classes (such as: ink concentrated on a few lines or dots in the image; ink fills a large solid area near the center of the image; ink fills a large solid area near a corner of the sheet; and the like) and the likelihood will depend upon the class into which the image has been classified.

The same database 70 may be used also for estimating a likelihood P2 that the sheet gets damaged in the process of printing the second image on the second side.

If the likelihood P1 is larger than P2, then the print order will be reversed. In that case, a blank sheet is fed to the print station 16, but the print head 54 is controlled to print the second image rather than the first image on the top side of the sheet. The sheet is then passed through the duplex path 50 and the first image is printed on the opposite side of the sheet. If the sheet were conveyed to the output section 14 in this state, the first image would face upwards, whereas for all other sheets, for which the print order has not been reversed, the first image faces downwards. In order to restore the page order of the document, it is therefore necessary to pass the printed sheet through the duplex path 50 once again in order to flip the sheet again into the correct orientation. When the main body of the printer 10 has the design shown in FIG. 12, this causes a loss in productivity because a part of the capacity of the duplex path 50 is required for the last flipping of the sheet.

Figure 2:
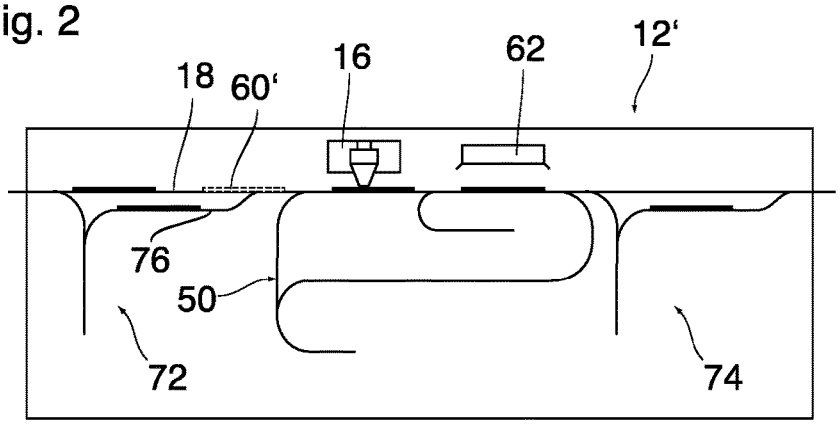
FIG. 2 is a schematic view of essential parts of a printer according to a modified embodiment.

FIG. 2 shows a printer main body 12' with a modified design which permits a higher productivity. In FIG. 2, an additional sheet reversing mechanism 72 is provided downstream of the duplex path 50 for carrying out the last sheet reversal in the stream of sheets that are conveyed to the output section. The sheet reversing mechanism 72 has an acceleration path 76 branching off from the main branch of the sheet supply path 18. On this acceleration path 76, the sheet is accelerated in order to give the sheet a head start which will provide sufficient time for the proper flipping operation. Consequently, when the sheet is returned into the main branch of the sheet transport path 18, it will precisely fit into a gap 60' which had been left in the stream of sheets. This permits to supply the print sheets in a non-interrupted sequence regardless of whether or not the print order has been reversed for some sheets.

In the example shown in FIG. 2, yet another sheet reversing mechanism 74 is provided upstream of the duplex path 50. This reversing mechanism is used when the sheets are of a type for which the physical properties of the first side of the sheet are different from the physical properties of the second side. For example, the first side of the sheet may be coated whereas the second side is not coated. If the job specifications require that the first image is printed on the coated side of the sheet, this would prohibit a reversal of the print order in the manner described above. However, the sheet reversing mechanism 74 permits to flip the sheet so that the coated side will face downward in the first duplex cycle where the second image will be printed on the non-coated side. Then, the first image will be printed on the correct side of the sheet in the second duplex cycle, whereafter the sheet is flipped again in the sheet reversing mechanism 72 in order to restore the page order.

In a modified embodiment the sheet reversing mechanisms 72 and 74 might also be incorporated in the input section 10 and the output section 14, respectively.

Figure 3:
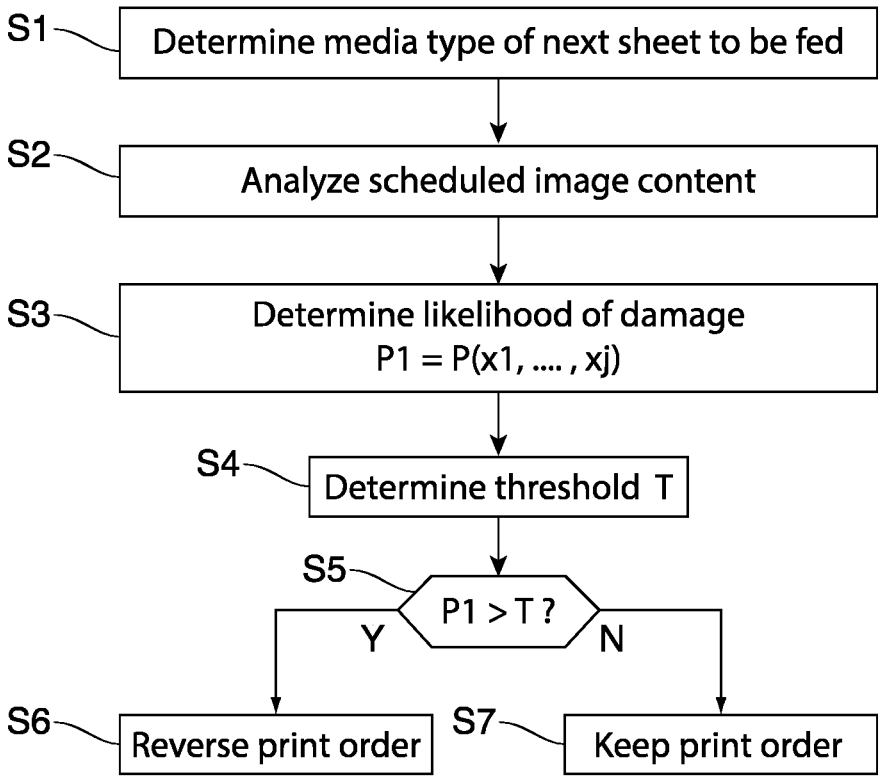
FIG. 3 is a flow chart illustrating essential steps of a method according to the invention.

An example of a method of deciding for each media sheet whether or not the print order shall be reversed has been shown in FIG. 3.

In step S1, a media type is determined for the next sheet to be fed from the input section 10 into the sheet transport path 18, typically by reference to corresponding instructions in the print job specifications.

Then, also by reference to the print job specifications, the image content of the image to be printed on the front side of the sheet is analysed in step S2. The purpose of this analysis is to determine factors such as the amount of ink and the ink distribution, that will influence the likelihood P1 together with other factors such as the media type.

In step S3, the likelihood P1 is determined as a function $P(x1, \ldots, xj)$ of the relevant factors $x1, \ldots, xj$, by reference to the database 70, said factors including among others the factors determined in steps S1 and S2.

In step S4, the threshold T is determined. For example, a fixed threshold T may be assigned to each media type so that the threshold determined in step S4 depends only on the media type as determined in step S1. In another embodiment, the threshold T will be equal to a likelihood P2 that the sheet gets damaged in the process of printing the second image on the second side. In that case, step S4 will comprise the steps analogous to the steps S1 to S3, but with the difference that, in step S2, it is the image content of the second image that is analysed. In yet another embodiment, the threshold T may be determined by adding a certain constant to the likelihood P2, in order to make sure, that the print order is reversed only if there is a significant difference between the likelihoods P1 and P2.

Then, it is checked in step S5 whether the likelihood P1 is larger than T or not, and if the answer is "yes" (Y), the print order is reversed in step S6. Otherwise, the print order is left as it is in step S7.

Figure 6:
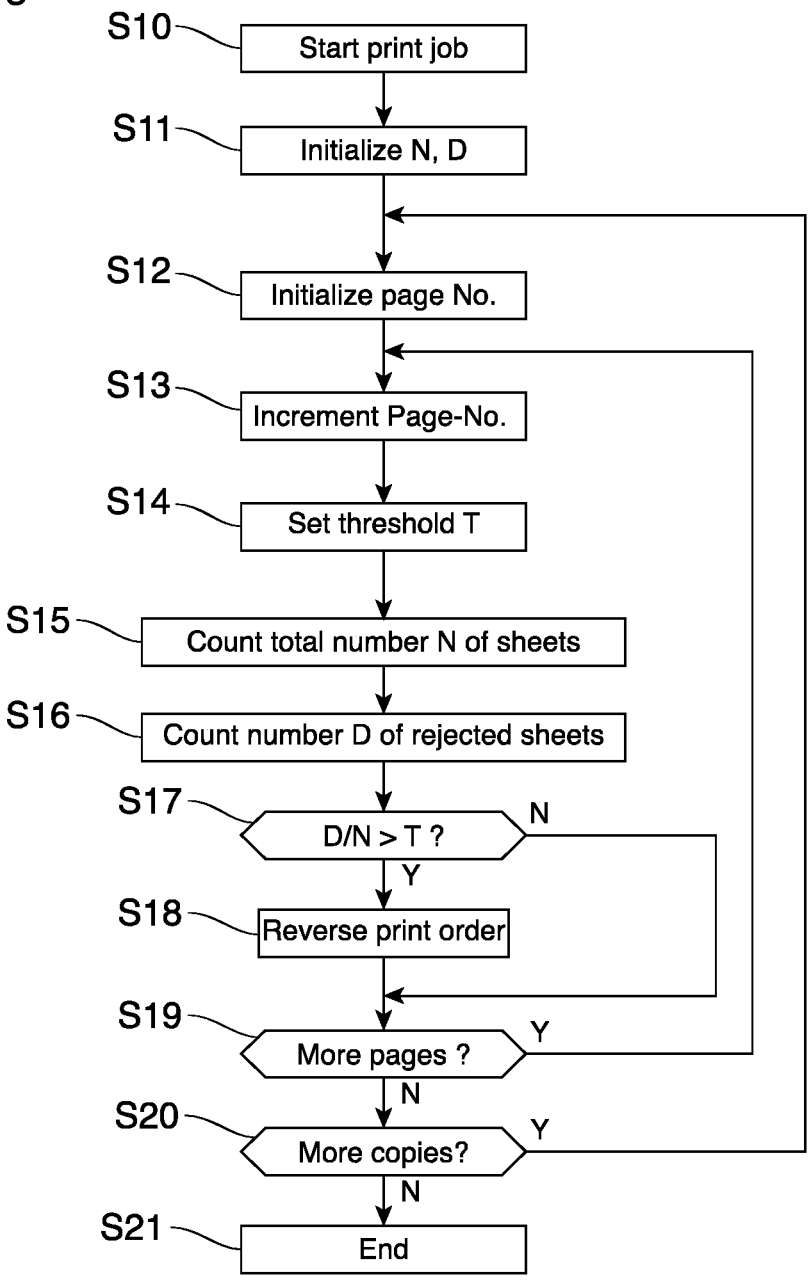
FIG. 6 is a flow diagram showing essential steps of a method according to another embodiment of the invention.

FIGS. 4 to 6 illustrate a modified embodiment in which the likelihood of damage is determined in the course of a print process in which several copies of a multi-sheet set are printed.

As is shown in FIG. 4, the sheet manager 38 keeps a log of all events where a sheet has been rejected by the sentry 62. For each event, the log stores: the cause of the event; i.e. the kind of defect that has led to the rejection of the sheet; the origin of the sheet, i.e. the input tray from which it was fed; the media type loaded in that tray; a page number indicating the position of the sheet in the set and, implicitly, the image contents that have been printed; and the time of the event. The log shown in FIG. 4 may be displayed on a screen of the user interface 22 upon a command of the user or operator.

Based on the log data, the sheet manager 38 keeps separate records for all pages in the set. These records may also be displayed on the user interface, as has been illustrated in FIG. 5. Each page is designated by a number (1-8), odd numbers indicating "first images" to be printed on the font side of the sheet, and even numbers indicating "second images". The sheet manager records for each page, or at least for each odd-numbered page: the threshold value T; a total number N of sheets that have been printed and bear a copy of the page; a number D of defective sheets that were scheduled for printing a copy of the page but have been rejected by the sentry 62; the quotient D/N; and the print order, "normal" or "reversed", that is used or has been used for the page. The currently valid print order is highlighted by a bold frame. If the quotient D/N is larger than the threshold value T, as in case of page No. 3 in the example shown in FIG. 5, then the sheet controller 38 will command a reversal of the print order.

For pages 1 and 2 (first sheet) the print order is "normal", i.e. page 1 is printed first. The quotient D/N is the best available estimate for the likelihood P1. The threshold T is set to be roughly equal to the average of the quotients D/N averaged over all copies of all pages that have been printed so far, this average representing a "natural damage rate". As long as the quotient D/N is smaller than the threshold T, the print order will be kept "normal".

When the print order is normal, it is not possible to count the number D of defective sheets for the even-numbered pages such as page 2, because the sheets do not move past the sentry 62 again after both sides of the sheet have been printed.

In case of page 3, when the total number N had reached 4000, the number D of defective sheets had reached the value 5, resulting in a D/N larger than the threshold 0.001, so that, at that instant, the print order had been switched to "reversed". Another 4550 copies of pages 3 and 4 have then been made in the reversed print order while counting the number D of defective sheets that have been produced in the process of printing page 4. As long as the quotient D/N for page 4 stays below the threshold of 0.001 (for page 3), the print process for pages 3 and 4 stays in the reversed mode.

In case of pages 5 and 6, the print order had been changed from "normal" to "reversed" at N=8500. Then another 50 copies have been printed in the reversed mode but have produced already a count D=2, indicating a large likelihood P2=0.004, larger than the original threshold T=0.001 for page 5. At this instant, the print order is switched back to "normal", and the threshold value for this sheet (pages 5 and 6) is lifted to T=0.004, i.e. T=P2. The print order will now stay "normal" as long as D/N for page 5 does not exceed the threshold of T=0.004.

Essential steps of the method according to this embodiment have been illustrated in FIG. 6.

A print job is started at step S10, and the counts N and D are initialized to "0" in step S11. Then, in step S12, the page number is initialized to "0", and the page number is then incremented by 1 in step S13.

In step S14, the threshold value T is set, e.g. in accordance with the principles explained in conjunction with FIG. 5. As long as N=0, the quotient D/N is not defined and T is fixed at a suitable standard value of e.g. T=0.001.

Step S15 consists in incrementing the total number N by 1 and is performed whenever, in the "normal" mode, an odd-numbered page is being printed. This is equivalent to counting the total number N of sheets.

Step S16 consists in incrementing the count D by 1 and is performed whenever an odd-numbered page has been printed but the sheet has then been rejected by the sentry 62.

In step S17, it is checked whether the quotient D/N is larger than the threshold T. If that is the case (Y), the print order is reversed in step S18. Otherwise (N), step S18 is skipped.

Then it is checked in step S19 whether the document or set to be printed contains more pages. If that is the case, the process loops back to step S13 where the page number is incremented and the next page is being processed. When a copy of the document has been completed (result N in step S19), it is checked in step 20 whether more copies of the document are to be printed. If that is the case, the process loops back to step S12 and the procedure is repeated for the next copy of the document. Otherwise, the process ends with step S21.

It will be understood that, for a page for which the print order has been reversed in step S18, step S15 consists in incrementing the count N whenever an even-numbered page (second image) has been printed, and step S16 consists in incrementing D whenever the sheet has been rejected after the even-numbered page has been printed.

Then, if it is found in step S17 that the quotient D/N for the even-numbered page exceeds the threshold, the step of reversing the print order in step S18 means that the "normal" print order is re-established. In that case, step S14 will comprise lifting the threshold T for the odd-numbered page to the quotient D/N that has previously been reached for the even-numbered page.

The invention claimed is:

1. A method of duplex printing on a cut sheet printer having a print station and a sheet supply system capable of feeding media sheets to the print station in a first orientation for printing a first image on the first side of the sheet and then in a second orientation for printing a second image on a second side of the sheet, the method comprising, for each sheet, the steps of:

(a) estimating a likelihood that, in a print process for printing the first image, the sheet will become damaged to such an extent that the damage will compromise a later print process for printing the second image;

(b) comparing the likelihood to a threshold; and (c) if the likelihood exceeds the threshold, reversing the print order so that the second image is printed before the first image.

2. The method according to claim 1, wherein the threshold is determined as dependent upon a likelihood that, in a print process for printing the second image with reversed print order, the sheet would become damaged to such an extent that the damage would compromise a later print process for printing the first image on the same sheet.

3. The method according to claim 2, wherein the likelihood is determined as dependent upon an image content of an image to be printed on the second side of the sheet.

4. The method according to claim 1, wherein, in step (a), the likelihood is determined as dependent upon an image content of an image to be printed on the first side of the sheet.

5. The method according to claim 4, wherein the likelihood and/or is determined by reference to a database.

6. The method according to claim 4, wherein the likelihood is determined as dependent upon an image content of an image to be printed on the second side of the sheet.

7. The method according to claim 1, for printing multiple copies of a multi-page document, wherein the steps (a)-(c) are performed repeatedly in the course of the print process, and, in step (a), the likelihood is determined, for each page to be printed on the first side of the sheets, as dependent upon a ratio between a count of damaged sheets and a count of a total number of sheets on which an image of the page has been printed on the first side.

8. A cut sheet printer comprising:

a print station; a sheet supply system capable of feeding media sheets to the print station in a first orientation for printing a first image on a first side of the sheet and then in a second orientation for printing a second image on a second side of the sheet; and a controller, wherein the controller is configured to perform the method according to claim 1.

9. The printer according to claim 8, further comprising a sheet reversing mechanism on an output side of a sheet supply path, for reversing the orientation of sheets that have been printed with reversed print order.

10. The printer according to claim 9, further comprising another sheet reversing mechanism on an input side of the sheet transport path, for reversing the orientation of sheets that are scheduled for being printed with reversed print order.

11. A software product comprising program code on a computer-readable non-transitory medium, the program code, when loaded into a controller, causes the controller to perform the method according to claim 1.

* * * * *